United States Patent [19]

Verpoort

[11] Patent Number: 4,869,645

[45] Date of Patent: Sep. 26, 1989

[54] COMPOSITE GAS TURBINE BLADE AND METHOD OF MANUFACTURING SAME

[75] Inventor: Clemens Verpoort, Fislisbach, Switzerland

[73] Assignee: BBC Brown Boveri AG, Baden, Switzerland

[21] Appl. No.: 167,015

[22] Filed: Mar. 11, 1988

[30] Foreign Application Priority Data

Mar. 19, 1987 [CH] Switzerland ..... 1055/87

[51] Int. Cl.[4] ..... B21K 3/04; F01D 5/34

[52] U.S. Cl. ..... 416/241 R; 29/156.8 B; 29/527.5; 164/98; 164/103

[58] Field of Search ..... 416/213 R, 241 R, 189; 29/156.8 H, 156.8 B, 156.8 R, 527.1, 527.5; 164/98, 103, 105; 415/212 R

[56] References Cited

U.S. PATENT DOCUMENTS

| | | | |
|---|---|---|---|
| 1,245,810 | 11/1917 | Smith | 416/189 |
| 2,834,537 | 5/1958 | Neary | 415/217 |
| 3,317,988 | 5/1967 | Endress | 416/241 R |
| 3,342,455 | 9/1967 | Fleck | 29/156.8 B X |
| 4,169,726 | 10/1979 | Fairbanks | 416/241 R X |
| 4,314,007 | 2/1982 | Gessinger | 416/241 R X |
| 4,370,789 | 2/1983 | Schilke et al. | 416/241 R X |
| 4,445,259 | 5/1984 | Ekbom | 29/156.8 B |
| 4,528,048 | 7/1985 | Gell et al. | 416/241 R X |
| 4,538,331 | 9/1985 | Egan | 29/156.8 R |
| 4,594,761 | 6/1986 | Murphy et al. | 29/156.8 B X |
| 4,677,035 | 6/1987 | Fiedler et al. | 416/241 R X |

FOREIGN PATENT DOCUMENTS

| | | |
|---|---|---|
| 1554000 | 1/1969 | France . |
| 480445 | 12/1969 | Switzerland . |

*Primary Examiner*—Robert E. Garrett
*Assistant Examiner*—Joseph M. Pitko
*Attorney, Agent, or Firm*—Burns, Doane, Swecker & Mathis

[57] ABSTRACT

A composite gas turbine blade consists of an airfoil (1) in an oxide-dispersion-hardened nickel-based superalloy, in the condition of longitudinally directed coarse columnar crystals, and a shroud plate (6) or a shroud and a root (7), the latter items in a non-dispersion-hardened nickel-based superalloy (cast alloy). The gas turbine blade is manufactured by casting in and casting round, using the non-dispersion-hardened superalloy mentioned, the tip end (2) and root end (3)—provided with depressions (4) and/or protrusions (5)—of the airfoil (1), after preheating the latter to a temperature of between 50° and 300° C. below the solidus temperature of the lowest melting phase of the airfoil material. The casting temperature for this should be a maximum of 100° C. above the liquidus temperature of the highest melting phase of this non-dispersion-hardened alloy. Any melting onto the airfoil (1) and any metallurgical connection is to be avoided. It is advantageous to provide a thermally insulating, mechanically damping intermediate layer (16) of an oxide of at least one of the elements Cr, Al, Si, Ti and Zr with a thickness of 5 to 200 μm between the airfoil (1), on the one hand, and the shroud plate (6) and the root (7), on the other.

21 Claims, 5 Drawing Sheets

COMPOSITE GAS TURBINE BLADE AND METHOD OF MANUFACTURING SAME

BACKGROUND OF THE INVENTION

1. Field of the Invention

Gas turbines for the highest requirements. Increasing the efficiency requires higher gas temperatures and hence higher temperature materials, more appropriate material combinations and better designs for the individual components. The most important and most critical of the components is the turbine blade.

The invention concerns the further development of mechanically and/or thermally highly loaded gas turbine blades, it being necessary to combine the advantageous properties of dispersion-hardened alloys for certain types of loading with those of non-dispersion-hardened alloys in an optimum manner.

In particular, it concerns a method for manufacturing a composite gas turbine blade consisting of root, airfoil and shroud plate or shroud, the airfoil consisting of an oxide-dispersion-hardened nickel-based superalloy in the condition of longitudinally directed coarse columnar crystals.

It also concerns a composite gas turbine blade consisting of a root, an airfoil and a shroud plate or a shroud, the airfoil consisting of an oxide-dispersion-hardened nickel-based superalloy in the condition of longitudinally directed coarse columnar crystals.

2. Discussion of Background

In rotating thermal machines (steam and gas turbines, for example), the ends of the blades are provided with shroud plates and/or shrouds at least in certain stages. The reasons for this are of a fluid mechanics, thermal and geometrical nature. These measures are therefore intended to improve the aerodynamics, the thermodynamics and the mechanics of the machine and to permit them to be designed with greater safety. in this connection, innumerable designs and material combinations are known for shroud plates and shrouds, their manufacture and the arrangements for fastening them to the tip end of the blade - including monolithic designs, forming an integral component with the airfoil. On this point, the following are some of the references which can be cited:

- Walter Traupel, Thermische Turbomaschinen [Thermal Turbo Machines], Vol. 2, Regelverhalten, Festigkeit und dynamische Probleme [Regulating Behavior, Strength and Dynamic Problems], Springer Verlag 1960
- H. Petermann, Konstruktion und Bandelemente von Stroemungsmaschinen, Springer Verlag 1960 Fritz Dietzel, Dampfturbinen [Steam Turbines], Georg Liebermann Verlag 1950
- Fritz Dietzel, Dampfturbinen, Berechnung, Konstruktion [Steam Turbines, Calculation and Design], Carl Hauser Verlag.

Oxide-dispersion-hardened nickel-based superalloys have recently been proposed as the blading materials for highly loaded gas turbines because they permit higher operating temperatures than conventional cast and forged superalloys. In order to obtain the best strength values (high creep strength) at high temeratures, components in these alloys are employed with coarse crystallites longitudinally extended and directed along the blade axis. In the course of manufacture, the workpiece (semi-finished product or blank) generally has to be subjected to a zone heat treatment process.

For various reasons (thermodynamics, crystallization laws), there are limits to the cross-sectional dimensions of such blading materials in the coarse-grained condition. In consequence, limits are also set to the blading dimensions. Now since the area of a shroud plate is generally several times the cross-sectional area of the corresponding blade airfoil, it is no longer possible, beyond certain dimensions, to manufacture blade and shroud plate monolithically from one piece. The same applies to the root part of the blade, which can become very voluminous in relative dimensions. If oxide-dispersion-hardened superalloys are to be successfully and generally employed, there is therefore a requirement for a division between the blade airfoil on the one hand and the shroud plate and root on the other. There are other reasons for such a division because of the strength and the material load at the clamping positions. Although a purely mechanical fastening of the shroud plate at the tip end of the blade airfoil can, fundamentally, solve the problem, it is expensive, requires additional fastening elements and can lead to additional operational stresses which are difficult to control. A welded connection is excluded because the structure of the oxide-dispersion-hardened material is substantially destroyed by the local melting. A connection by means of brazing or diffusion bonding demands very carefully machined contact surfaces and is associated with technological difficulties.

Casting in metallic workpiece parts, and casting around them, using a metallic material —usually of a lower melting point —is, in itself, known state of the art from numerous applications. It has already been proposed, inter alia, to cast steel into cast iron. It is then necessary to ensure that the steel has, as far as possible, a thermal expansion coefficient which is smaller or at most equal to that of the cast iron. Suitable steels for this purpose are, for example, those with 10 to 18% chromium content. The method has been used, inter alia, for casting around turbine blades (cf. CH-A-480 445). Intermediate layers of oxides are then said to be advantageous.

In the construction of highly loaded thermal machines, in particular gas turbines, there is a large requirement to employ oxide-dispersion-hardened superalloys to an increased extent and, consequently, to provide the designer with the technological means permitting him to employ these alloys in a substantially optimum manner while retaining the maximum possible design freedom.

SUMMARY OF THE INVENTION

Accordingly, one object of this invention is to provide a composite gas turbine blade consisting of root, airfoil and shroud plate or shroud and a method for its manufacture, where, on the one hand, optimum use is to be made of the employment of oxide-dispersion-hardened nickel-based superalloys for the blade airfoil while taking more account of their limited available crosssectional dimensions in the condition of longitudinally directed coarse columner crystals and, on the other hand, an optimum relationship to the airfoil and hence a composite design most suited to all the thermal and mechanical operating conditions is to be achieved by appropriate selection of the material and design of the root and the shroud plate or shroud and of their manufacturing method. The different thermal and mechanical loads on the blade root part, airfoil, blade tip part and shroud plate or shroud should at the same time be taken into account, allowing for normal operation, operational interruptions (shutting down and starting up the turbine) and sudden rejection of load (suddenly switching off the generator coupled to the turbine while the machine group continues to run).

This object is achieved, in the method mentioned at the beginning, by providing both the tip end and the root end of the airfoil with depressions and/or protrusions on the external surface, by inserting the airfoil into a mold having the negative shape of the shroud plate and the root in such a way that the tip end and the root end protrudes into the hollow space of the mold, by the airfoil being preheated to a temperature which is between 50° and 300° C. below the solidus temperature of the lowest melting phase of the airfoil material, and by the hollow space of the mold being filled with the melt of a non-dispersion-hardened nickel-based superalloy intended for the shroud plate and the root at a casting temperature which is at the most 100° C. above the liquidus temperature of the highest melting phase of this alloy, in such a way that the tip end and the root end of the airfoil are completely cast around and cast in, and that the temperature of the melt, after the conclusion of the casting procedure and during solidification, and that of the airfoil, are controlled in such a way that any melting onto the airfoil and any metallurgical connection between the material of the airfoil and that of the shroud plate and the root is avoided and that the whole workpiece is cooled to room temperature.

The object is also achieved in that, in the composite gas turbine blade mentioned at the beginning, the root and the shroud plate consist of a non-dispersion-hardened nickel-based cast superalloy and that the root and the shroud plate are fastened purely mechanically by casting around and casting in over depressions and/or protrusions at the root end and the tip end of the outer surface of the blade airfoil while maintaining a metallic discontinuity and without any metallurgical connection.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 is a diagrammatic longitudinal section (elevation) through a casting device for the tip end of this blade airfoil which has to be cast in.

DESCRIPTION OF THE PREFERRED EMBODIMENTS

Figure 1:
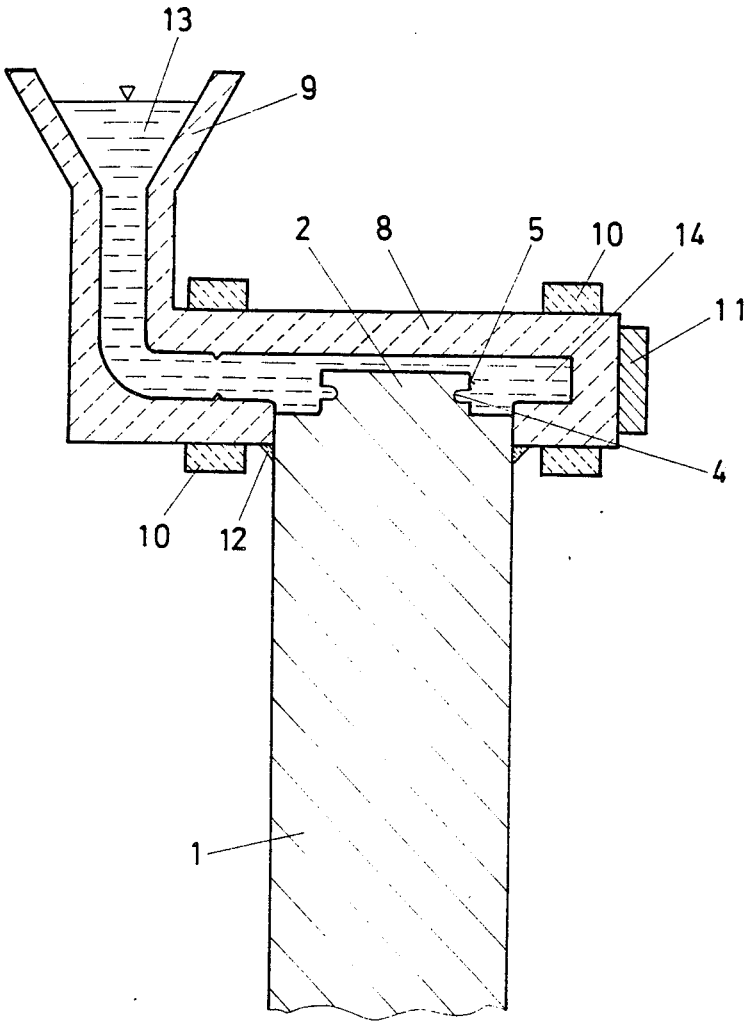

Referring now to the drawings, wherein like reference numerals designate identical or corresponding parts throughout the several views, in FIG. 1 there is shown a diagrammatic longitudinal section (elevation) through a casting device for the tip end of an airfoil, which has to be cast in, is represented in FIG. 1. The oxide-dispersion-hardened nickel-based superalloy airfoil, whose longitudinal axis is in the vertical position, is indicated by 1. The tip end 2, which has to be cast in and cast round, is at the top. Relative to the active profile of the airfoil 1, it is reduced in its transverse dimensions and has a peripheral depression 4 and a similar protrusion 5 for the purpose of better mechanical anchoring of the shroud plate, which has to be to be produced and fastened by casting around the airfoil (reference sign 6 in FIG. 2). 8 is the mold, consisting of ceramic, which corresponds on its concave side to the shape of the shroud plate to be manufactured (negative shape). 9 is the side pouring cup for the mold 8. So that the casting temperature can be kept low, thermally insulated packings 10 and a heating plate 11 are provided on the outside of the mold 8 at critical high heat removal points. In order to avoid any possible seepage of the nickel-based superalloy melt 13 in the gap between the mold 8 and the outer surface of the airfoil 1, a collar-shaped seal 12 made from ceramic adhesive and extending around the whole of the airfoil is provided at the corresponding re-entrant corner on the outside of the mold. FIG. 1 represents the time at which the casting procedure ends. 14 represents the part of the melt 13 forming the shroud plate.

Figure 2:
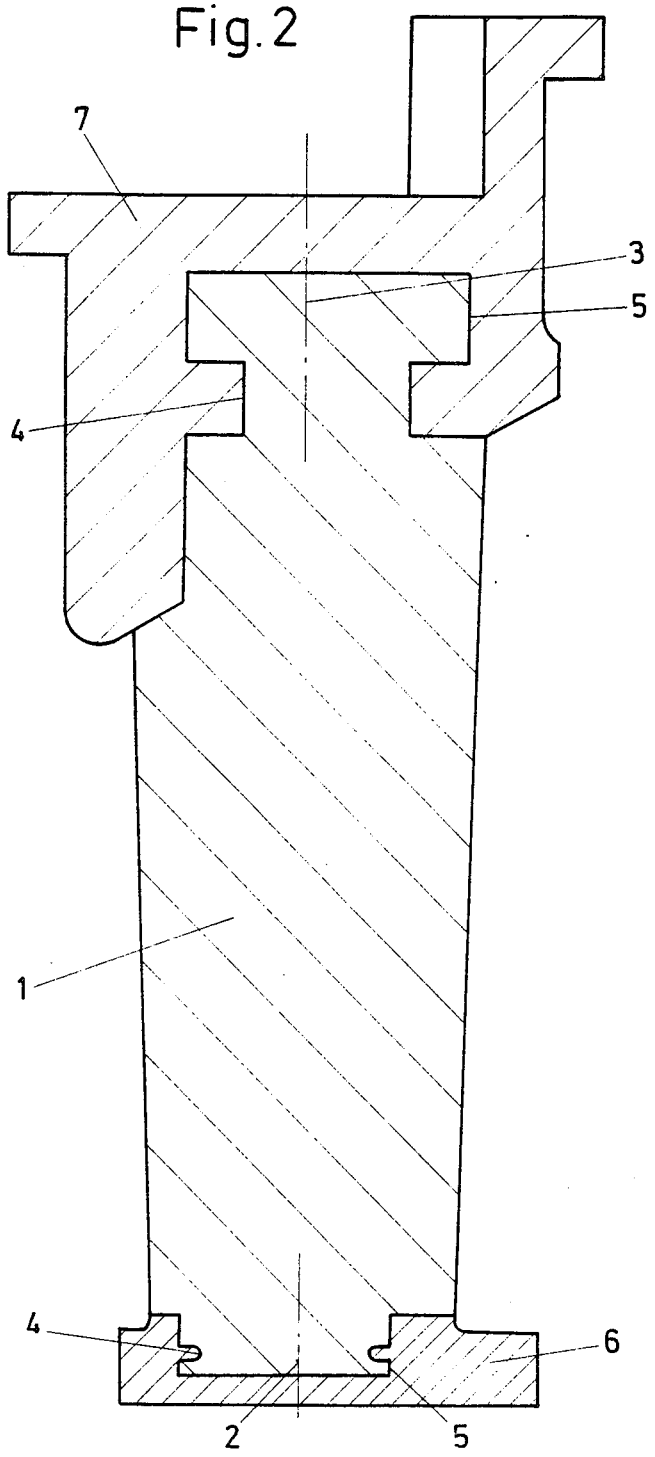
FIG. 2 is a diagrammatic longitudinal section through a composite guide blade for a gas turbine.

FIG. 2 shows a diagrammatic longitudinal section through a composite guide blade for a gas turbine. 1 is the airfoil consisting of an oxide-dispersion-hardened nickel-based superalloy having coarse columnar crystals, oriented in the longitudinal direction by zone heat treatment. 2 is the tip end and 3 the root end of the airfoil 1, both of which possess a peripheral depression 4 and a peripheral protrusion 5. 6 is the shroud plate or shroud and 7 is the root of the blade. Each of them consists of a non-dispersion-hardened nickel-based cast superalloy. 6 and 7 generally exhibit a fine grain to medium grain crystal structure—depending on the composition, casting temperature and cooling conditions.

Figure 3:
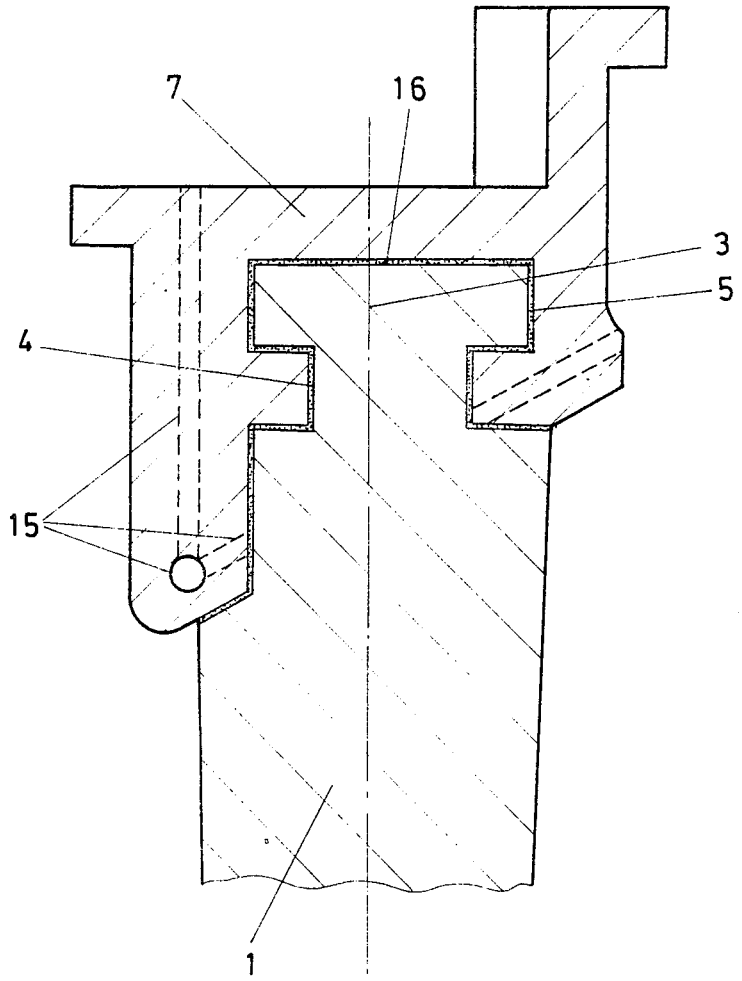
FIG. 3 is a diagrammatic longitudinal section through the root part of a guide blade for a gas turbine, with an intermediate layer between the airfoil and the root part.

FIG. 3 shows a diagrammatic longitudinal section through the root part of a guide blade for a gas turbine; the root has cooling ducts and there is an intermediate layer between the root and the airfoil. 15 are cooling ducts in the root 7 of the blade. 16 is a thermally insulating oxide layer preventing metallurgical connection between the airfoil 1 and the root 7 and consisting of an oxide. This can be a naturally occurring oxide layer of the airfoil 1 of a few μm thickness or it can be a layer, specially applied on the outer part of the airfoil 1, of an oxide selected from the elements Cr, Al, Si, Ti and Rz with a thickness of between 5 and 200 μm.

Figure 4:
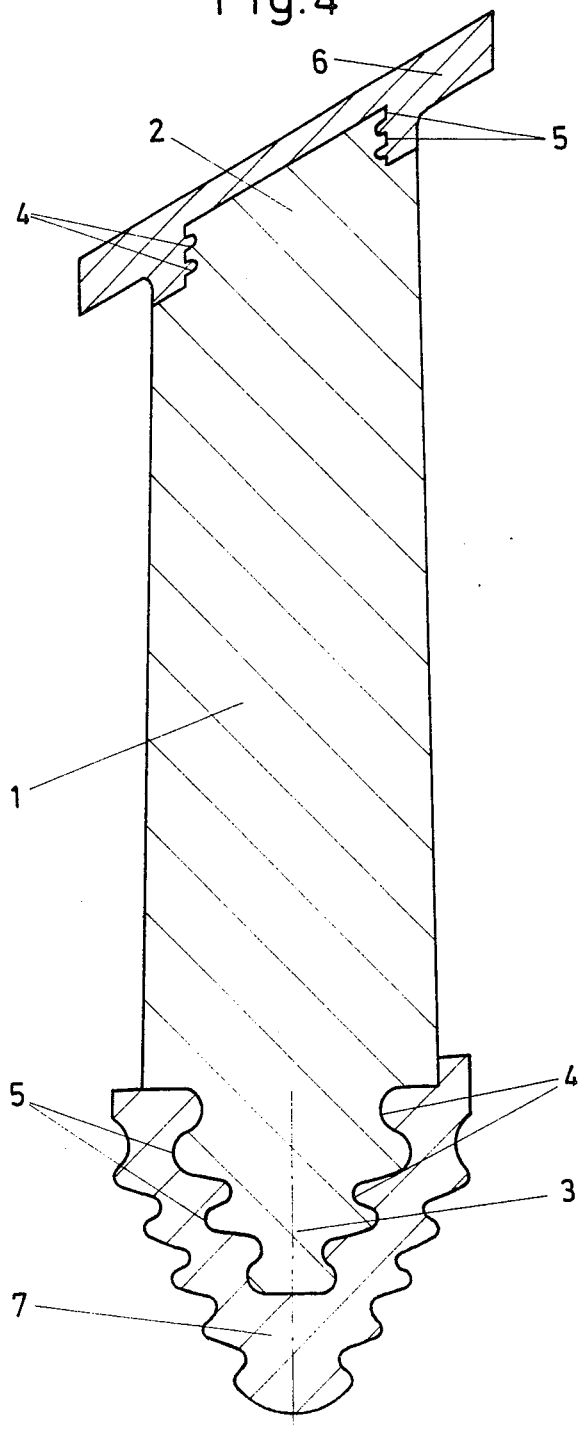
FIG. 4 is a diagrammatic longitudinal section through a composite rotor blade for a gas turbine.

A diagrammatic longitudinal section through a composite rotor blade for a gas turbine is represented in FIG. 4. All the reference signs correspond in principle to those of the preceding figures. Only the shapes of the components are different. The root part of the blade has a double set of fir tree teeth, which ensure good retention in the rotor body of the turbine.

Figure 5:
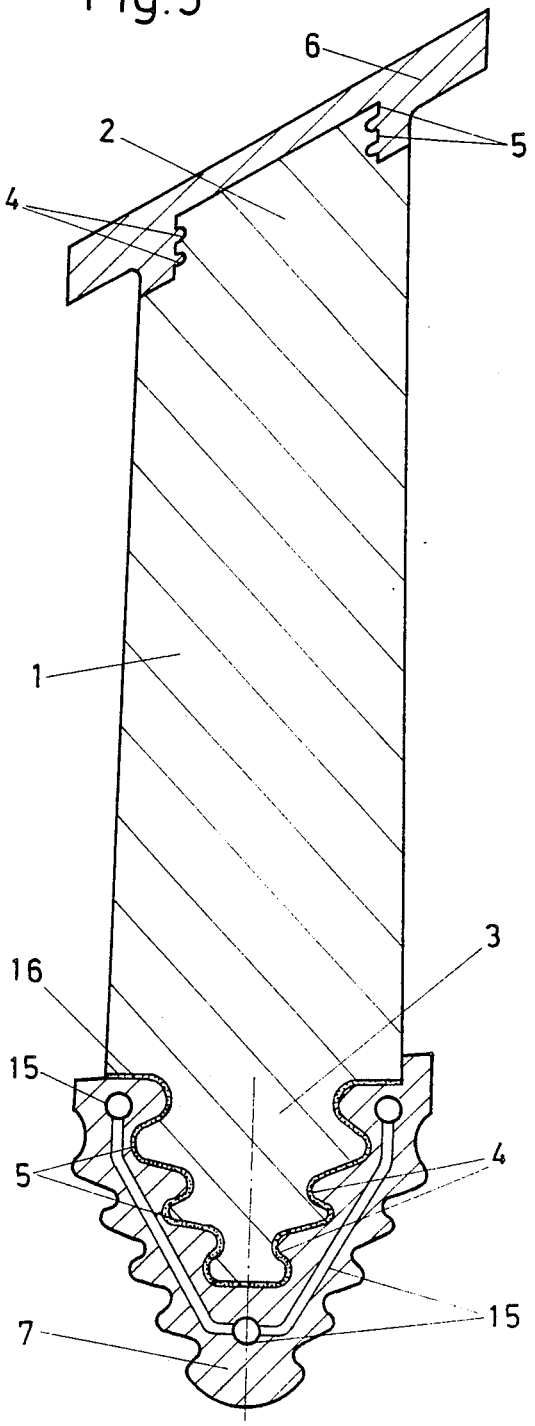
FIG. 5 is a diagrammatic longitudinal section through a composite rotor blade with intermediate layer and cooling ducts in the root part.

FIG. 5 shows a diagrammatic longitudinal section through a composite rotor blade with intermediate layer and cooling ducts in the root part. The individual components and reference numerals correspond in principle to those of FIG. 4. The shroud plate 6 consisting of a non-oxide-dispersion-hardened nickel-based superalloy, with depressions 4 and protrusions 5 for anchoring purposes, is located at the tip end 2 of the oxide-dispersion-hardened nickel-based superalloy airfoil 1. The root end 3 of the airfoil 1 is made fir tree-shaped with depressions 4 and protrusions 5 and is inserted in turn in a fir tree-shaped root 7 in a nickel-based cast superalloy. The root 7 is provided with cooling ducts 15. There is an intermediate oxide layer with a thickness of up to 200 μm between the root end 3 of the airfoil 1 and the root 7. This acts elastically when accepting clamping forces and expansion differences during rapidly changing operating conditions (thermal shock, etc.) and provides heat insulation between the blade and the rotor body.

Illustrative Example 1

See FIGS. 1 and 2.

An airfoil 1 for a gas turbine guide blade was manufactured by machining from an oxide-dispersion-hardened nickel-based superalloy. The material was available in the form of a prismatic semi-finished product with a rectangular cross-section of 100 mm width and 32 mm thickness in the zone heat-treated recrystallized coarse grained condition. The longitudinally directed columnar crystals have, on average, a length of 20 mm, a width of 6 mm and a thickness of 3 mm. The INCO material, designated with the commercial name MA 6000, had the following composition:

| | | |
|---|---|---|
| Cr = | 15.0 | % by weight |
| Al = | 4.5 | % by weight |
| Ti = | 2.5 | % by weight |
| Mo = | 2.0 | % by weight |
| W = | 4.0 | % by weight |
| Ta = | 2.0 | % by weight |
| Zr = | 0.25 | % by weight |
| B = | 0.01 | % by weight |
| C = | 0.05 | % by weight |
| $Y_2O_3$ = | rest | % by weight |

The airfoil 1 with wing section profile had the following dimensions:

Total length =180 mm
Maximum width =85 mm
Maximum thickness =24 mm
Section height =30 mm The outer surface of the tip end 2 of the airfoil 1 was set back. The set-back part had a depression 4 in the shape of a peripheral rounded groove of 4 mm depth and 2.5 mm width. By this means, a protrusion 5 was formed at the outermost end.

The airfoil 1 was now heated to a temperature of 1140° C. and inserted in the similarly pre-heated ceramic mold 8 so that the tip end 2 protruded into the hollow space of the mold. The mold 8 was sealed against the airfoil 1 by means of the seal 12 made of ceramic adhesive. A melt of a superalloy was now poured via the pouring cup 9 into the hollow space of the mold 8 so that its part 14, subsequently forming the shroud plate, surrounded the tip end 2 of the airfoil 1. The non-dispersion-hardened nickel-based cast superalloy used for the melt 13, with the INCO commercial name IN 738, had the following composition:

| | | |
|---|---|---|
| Cr = | 16.0 | % by weight |
| Co = | 8.5 | % by weight |
| Mo = | 1.75 | % by weight |
| W = | 2.6 | % by weight |
| Ta = | 1.75 | % by weight |
| Nb = | 0.9 | % by weight |
| Al = | 3.4 | % by weight |
| Ti = | 3.4 | % by weight |
| Zr = | 0.1 | % by weight |

-continued

| | | |
|---|---|---|
| B = | 0.01 | % by weight |
| C = | 0.11 | % by weight |
| Ni = | rest | |

This alloy has a liquidus temperature of about 1315° C. The maximum casting temperature was 1380° C. After the relatively rapid solidification of the melt 14, the workpiece was slowly cooled. Because of the low casting temperature, a medium-grained to fine-grained structure was obtained for the shroud plate 6. The latter had the following dimensions:

Average thickness =10 mm
Width =70 mm
Length =90 mm

The investigations showed that there was no metallurgical connection of any type between the airfoil 1 and the shroud plate 6, i.e. there was no melting onto the structure of the tip end 2. The connection was of a purely mechanical type, a natural oxide layer of approximately 3 μm thickness on the surface of the airfoil 1 preventing direct metallic contact.

The finished blade was subjected to a 5 minute cycle between the temperature limits of about 200° C. and 1000° C. in order to test its sensitivity to thermal shock. No cracks and no loosening of the shroud plate 6 from the airfoil 1 could be found after 500 cycles. The natural oxide skin between these two parts itself acted as a thermal insulating layer so that the maximum temperature reached by the shroud plate was 800° C. This has an advantageous effect in service, particularly when shutting down or when the generator load is shed.

In general, the preheating temperature of the airfoil 1 in the present case should be between 1140° and 1180° C. and the maximum casting temperature of the melt 13 should be 1380° C.

Illustrative Example 2

See FIGS. 1 and 2.

An airfoil 1 was manufactured from an oxide-dispersion-hardened nickel-based superalloy as described in Example 1. The alloy composition and the dimensions were exactly the same as in Example 1. The airfoil 1 was pre-heated to a temperature of 1160° C., its tip end 2 was inserted in a mold 8 as shown in FIG. 1 and its root end 3 was inserted in a corresponding mold (not shown). The hollow spaces of both molds were now filled simultaneously with a melt 13 of a non-dispersion-hardened nickel-based cast superalloy with the INCO commercial designation IN 939. The alloy had the following composition:

| | | |
|---|---|---|
| Cr = | 22.4 | % by weight |
| Co = | 19.0 | % by weight |
| Ta = | 1.4 | % by weight |
| Nb = | 1.0 | % by weight |
| Al = | 1.9 | % by weight |
| Ti = | 3.7 | % by weight |
| Zr = | 0.1 | % by weight |
| C = | 0.15 | % by weight |
| Ni = | rest | |

This alloy had a liquidus temperature of about 1340° C. The maximum casting temperature was 1400° C. Otherwise, the procedure was exactly the same as in Example 1. The investigation showed that there was no metallurgical connection of any sort between the airfoil 1, on the one hand, and the shroud plate 6 or root 7, on the other. Testing for resistance to temperature changes showed a freedom from cracks and no loosening of the shroud plate 6 or the root 7 from the airfoil 1.

In the interest of freedom from blow holes and the lowest possible porosity, attention should be paid in the design of the shroud plate 6, and particularly of the root 7, to ensuring that material accumulations of the cast superalloy are avoided.

In general, the preheating temperature of the airfoil 1 in the present case should be between 1160° and 1200° C. and the casting temperature of the melt 13 should be a maximum of 1400° C.

Illustrative Example 3

See FIGS. 1 and 3.

An airfoil 1 for a gas turbine guide blade was manufactured by machining it from an oxide-dispersion-hardened nickel-based superalloy. Both the semi-finished product used as the initial material and exhibiting the coarse-grained longitudinally directed columnar crystals and the finished airfoil had the same dimensions as in Example 1. The alloy had the following composition:

| | |
|---|---|
| Cr = | 20.0 % by weight |
| Al = | 6.0 % by weight |
| Mo = | 2.0 % by weight |
| W = | 3.5 % by weight |
| Zr = | 0.19 % by weight |
| B = | 0.01 % by weight |
| C = | 0.01 % by weight |
| $Y_2O_3$ = | 1.1 % by weight |
| Ni = | rest |

The outer surface of the root end 3 of the air-foil 1 was set back and it had a rectangular depression 4 of 10 mm depth and 14 mm width, together with a corresponding protrusion 5 of 10 mm thickness and 13 mm width. The complete surface of the root end 3 of the airfoil 1 was provided, by means of the plasma spray method, with an intermediate layer 16 of $Al_2O_3$ approximately 150 μm thick.

The subsequent procedure was now the same as that given in Example 1. The airfoil 1 was heated to a temperature of 1120° C. and inserted in an appropriate ceramic mold. The cast superalloy IN 738 used was exactly the same as that of Example 1. The maximum casting temperature was 1380° C. In the interest of better cooling of the root 7, to avoid material accumulations and to provide a lighter construction, the root was provided with cooling ducts 15. Despite the intermediate layer 16, the mechanical connection between the airfoil 1 and the root 7 was very good. The resistance to temperature changes was excellent. No cracks could be found after 1000 cycles. The intermediate layer 16 was found to be an outstanding thermal insulating layer. The root only reached a temperature of about 700° C. for an average airfoil temperature of 1000° C.

In general, the preheating temperature of the airfoil should be between 1120° and 1160° C. in the present case and the maximum casting temperature of the melt 13 should be 1380° C.

Illustrative Example 4

See FIGS. 1 and 4.

An airfoil 1 for a gas turbine rotor blade was manufactured by machining it from an oxide-dispersion-hardened nickel-based superalloy. The material was available in the form of a prismatic semi-finished product with a rectangular cross-section of 100 mm width and 30 mm thickness in the zone heat-treated re-crystallized coarse-grained condition. The longitudinally directed columnar crystals had, on average, a length of 25 mm, a width of 8 mm and a thickness of 3.5 mm. For the purpose of increasing the ductility at right angles to the longitudinal direction of the columnar crystals, the semi-finished product was subjected, before machining, to a heat treatment which consisted of heating at, or just above, the lowest possible solution heat treatment temperature for the $\gamma'$-phase in the $\gamma$-matrix, followed by cooling at a maximum cooling rate of 5° C./min. The material had exactly the same composition as that in Example 3.

The airfoil 1 had a wing section profile with the following dimensions:

Total length =200 mm
Maximum width =70 mm
Maximum thickness =20 mm
Section height =28 mm The outer surface of the tip end 2 of the air-foil 1 was set back. The set-back part had depressions 4 in the form of peripheral grooves, rounded at the bottom, of 2 mm depth and 2 mm width. The protrusions 5 between the grooves had similar dimensions.

The airfoil 1 was now pre-heated to a temperature of 1120° C. and put into a mold, also preheated, similar to 8 in FIG. 1.

The further procedure was the same as that in Example 1. The cast superalloy IN 939 with the composition of Example 2 was used for the melt 13. The maximum casting temperature was 1400° C. Solidification took place in a relatively short time and the result was a fine-grained structure. After solidification, the workpiece was slowly cooled. The shroud plate 6 had the following dimensions:

| | |
|---|---|
| Average thickness = | 8 mm |
| Width = | 80 mm (measured oblique to the airfoil) |
| Length = | 100 mm |

The natural oxide layer between the airfoil 1 and the shroud plate 6 had an average thickness of between 3 and 5 μm.

The resistance to temperature changes was very good in the range between 200° and 1000° C. No cracks could be found in the airfoil 1 or in the shroud plate 6 after 500 cycles.

In general, the preheating temperature of the airfoil 1 should be between 1120° and 1160° C. in the present case and the maximum casting temperature of the melt 13 should be 1400° C.

Illustrative Example 5

See FIGS. 1 and 4.

An airfoil 1 was manufactured from an oxide-dispersion-hardened nickel-based superalloy as described in Example 4. The alloy composition was selected as follows:

| | |
|---|---|
| Cr = | 17.0 % by weight |
| Al = | 6.0 % by weight |
| Mo = | 2.0 % by weight |
| W = | 3.5 % by weight |
| Ta = | 2.0 % by weight |

-continued

| | |
|---|---|
| Zr = | 0.15 % by weight |
| B = | 0.01 % by weight |
| C = | 0.05 % by weight |
| $Y_2O_3$ = | 1.1 % by weight |
| Ni = | rest |

In contrast to Example 4, however, the semi-finished product was not previously subjected to heat treatment to increase the ductility.

The dimensions of the airfoil were the same as those of Example 4. Seen in the axial plane of the turbine rotor, the root end 3 of the airfoil 1 had a shape similar to a fir tree with three depressions 4 and three protrusions 5, this ensuring excellent retention in the root 7 (see FIG. 4).

The airfoil 1 was preheated to a temperature of 1130° C. and its tip end 2 and its root end 3 were respectively inserted in appropriate preheated molds and sealed with ceramic adhesive. The hollow spaces of the two molds were simultaneously filled with a melt 13 of the cast superalloy IN 738 with composition as given in Example 1. The casting temperature was 1380° C. The procedure was otherwise as given in the preceding examples. The mold for the root 7 was constructed in such a way that the latter also had, in the final condition, a fir tree shape —in axial section of the rotor. Five depressions alternated with five protrusions, those near the root end 3 of the airfoil 1 being more or less opposite to the corresponding depressions 4 and protrusions 5. By this means, excellent airfoil 1/root 7/rotor body engagement was achieved although no metallurgical connection of any sort was present.

The blades satisfactorily withstood the thermal shock tests. After 1000 cycles, no cracks of any sort could be found nor was there any loosening of the anchoring between the airfoil 1, on the one hand, and the shroud plate 6 and the root 7, on the other.

In general, the preheating temperature of the airfoil 1 should be between 1130° and 1170° C. in the present case and the maximum casting temperature of the melt 13 should be 1380° C.

Illustrative Example 6

See FIGS. 1 and 5.

An airfoil 1 for a gas turbine rotor blade was manufactured by machining it from an oxide-dispersion-hardened nickel-based superalloy available as a semi-finished product, as described in Example 5, which had not been previously pretreated by a heat treatment to increase the ductility. The composition of the material and the dimensions and shape of the airfoil correspond exactly to the values given in Example 5.

The complete surface of the fir tree-shaped root end 3 of the airfoil 1 was provided with an intermediate layer 16 of $ZrO_2$, with an addition of 1% $Y_2O_3$ and having an average thickness of 80 μm, applied by the plasma spray method.

The airfoil 1 was now heated to a temperature of 1180° C. in order to bring the highest possible proportion of the $\gamma'$-phase in the $\gamma$-matrix of the material into solution. The root end 3 of the airfoil 1 was then put into an appropriately preheated mold provided with cores, and sealed with ceramic adhesive. The cast superalloy IN 939 with the composition of Example 2 and a liquidus temperature of about 1340° C. was used as the melt 13. The casting temperature was 1380° C. Thanks to the cores intended for the cooling ducts 15, impermissible material accumulation was avoided in the region of the root 7. By this means, the solidification process could be arranged in an optimum manner and a fine-grained structure obtained. The further cooling of the workpiece was carefully monitored. A cooling rate of a maximum of 5°C/min was maintained down as far as 600° C. From there downwards, the workpiece was left to its own natural cooling. By this procedure, the ductility of the airfoil material, particularly in the direction transverse to the longitudinally directed columnar crystals, was substantially increased relative to the supply condition. This is of critical importance, particularly for the operational behavior of the retention in the root end 3 of the airfoil 1. The security against cracking or loosening in this highly loaded region of the blade is substantially increased by this increase in ductility.

The thermal shock test of 1000 cycles between 100 and 1000° C. airfoil temperature, applied simultaneously with cyclic tensile loading, showed the excellent thermal, mechanical and thermal-mechanical behavior of this non-metallic connection under dynamic conditions. The intermediate layer 16 acted not only as a thermal insulation layer but —as the transmission element for elastic clamping —also provided an important mechanical function in the reduction of stress peaks. At the same time, an almost ideal composite body was produced for the various types of loads: airfoil 1 with coarse grain for high creep strength at the maximum temperatures; root 7 with fine grain for high mechanical alternating load at medium temperatures; no metallurgical connection between 1 and 7 with a critical transition zone to disturb the structure.

In general, the preheating temperature of the airfoil 1 should be between 1160° and 1180° C. in the present case and the maximum casting temperature of the melt 13 should be 1400° C.

Illustrative Example 7

See FIGS. 1 and 4.

An airfoil 1 was manufactured from an oxide-dispersion-hardened nickel-based superalloy as described in Example 5. The alloy composition and the dimensions corresponded to the values given in Example 5.

The airfoil 1 was heated to a temperature of 1180° C. and its tip end 2 and its root end 3 were each placed in corresponding preheated molds and sealed with ceramic adhesive. The hollow spaces of the molds were simultaneously filled with a melt 13 of the cast superalloy IN 738 with the composition given in Example 1. The casting temperature was 1370° C. The cooling was controlled in such a way that after the solidification of the melt 13 had been completed, the transition through the temperature range from 1200° C. down to 600° C. took place in just 2 hours. By this means, an increase in the ductility of the airfoil material was achieved.

The finished workpiece was now subjected to post-compression in the region of the shroud plate 6 and the root 7. The workpiece was first brought to a temperature of 1140° C. without the use of pressure. This temperature was in a region which was at least 100° C. but a maximum of 150° C. lower than the recrystallization temperature of the materials, of both the airfoil and the shroud plate 6 and the root 7. The workpiece was then subjected to a pressure of 2000 bar from all sides and, by this means, hot pressed isostatically for 3 hours. The cooling took place at a rate of 5° C./min. By this means, the highest possible ductility was achieved in the transverse direction of the airfoil 1. The investigation showed that a density of 100% of the theoretical value was achieved for the shroud plate 6 and the root 7.

The strength of these two workpiece parts 6 and 7 reached at least the values of a normal comparison body cast at high temperatures and densely solidified. The thermal shock testing and the dynamic loading at high temperatures provided excellent results. No cracking or loosening could be observed in the composite body.

The invention is not limited to the illustrative examples. Oxide-dispersion-hardened nickel-based superalloys for the airfoil 1 and non-oxide-dispersion-hardened nickel-based superalloys for the shroud plate (the shroud) 6 and the root 7 of compositions different from those given can, in principle, be used. The preheating temperature for the airfoil 1 should be in the range between 50° and 300° C. under the solidus temperature of the lowest melting phase of the airfoil material, and the casting temperature of the melt 13 of the non-dispersion-hardened nickel-based superalloy should be at most 100° C. over the liquidus temperature of the high-est melting phase of this alloy. The temperature of the melt 13 after the conclusion of the casting process and during solidification and that of the airfoil 1 has to be controlled in such a way that any melting onto the airfoil 1 and any metallurgical connection between the airfoil 1 and the shroud plate 6 or between the airfoil 1 and the root 7 is avoided. The complete workpiece then has to be cooled to room temperature in a controlled manner.

The airfoil material (semi-finished product) or the airfoil 1 itself are preferably subjected to heat treatment before metal is cast around them in order to increase the ductility at right angles to the longitudinal direction of the columnar crystal; this heat treatment consists of heating at or immediately above the heat treatment temperature for solution of the $\gamma'$-phase in the $\gamma$-matrix of the airfoil material, followed by cooling at a maximum of 5° C./min. Alternatively, the airfoil 1 can be preheated to a temperature which at least reaches a value of 50° C. below the lowest possible solution heat treatment temperature of the $\gamma'$-phase. After casting, the airfoil 1 should be cooled at a maximum rate of 5° C./min down as far as 600° C. The material can then be cooled to room temperature at an arbitrary cooling rate.

The airfoil 1 can preferably be provided, at least at the tip end 2 and the root end 3, with an intermediate layer 16 between 5 and 200 μm thick of an oxide of at least one of the elements Cr, Al, Si, Ti and Zr before metal is cast around them.

For the post-compression of the shroud plate 6 and the root 7, the complete workpiece is, after cooling to room temperature, advantageously brought again to a temperature between 1050° and 1200° C. and at least 6 and/or 7 is subjected to hot isostatic pressing, the workpiece being heated to a temperature which is at least 100° C. but a maximum of 150° C. lower than the recrystallization temperature of the material both of the airfoil 1 and of the shroud plate 6 and the root 7; they are held under a pressure of between 1000 and 3000 bar at this temperature for between 2 and 24 hours and then cooled at a maximum rate of 5° C./min at least as far as 600° C.

Under all circumstances, care must be taken to ensure that there is a metallic discontinuity and no sort of metallurgical connection between the airfoil 1 and the shroud plate 6 or the root 7 of the finished composite gas turbine blade. The discontinuity can consist partially of the natural oxide layer and partially of hollow spaces and have a maximum width of 5 μm. An intermediate layer 16, consisting of an oxide of at least one of the elements Cr, Al, Si, Ti and Zr of a thickness of between 5 and 200 μm, can also, however, be present at the location of the metallic discontinuity. This intermediate layer is preferably provided as a firmly adhering layer of at least 100 μm thickness on the airfoil 1, consisting mainly of $Al_2O_3$ or of $ZrO_2$ stabilized with $Y_2O_3$.

The airfoil 1 advantageously consists of an oxide-dispersion-hardened, non-precipitation-hardened nickel-based superalloy with increased ductility at right angles to the longitudinal direction of the columnar crystals. In the interest of compliance, therefore, the additional hardening associated with precipitation is deliberately omitted in this case.

Obviously, numerous modifications and variations of the present invention are possible in the light of the above teachings. It is therefore to be understood that within the scope of the appended claims, the invention may be practiced otherwise than as specifically described herein.

What is claimed as new and desired to be secured by letters patent of the United States is:

1. A method for manufacturing a composite gas turbine blade including a root, an airfoil and a shroud, the airfoil including an oxide-dispersion-hardened nickel-based superalloy in the condition of longitudinally directed coarse columnar crystals, wherein the outside surface of both the tip end and the root end of the airfoil are provided with depressions and/or protrusions, comprising the steps of:

inserting the airfoil in a mold having the negative shape of the shroud and the root in such a way that the tip end and the root end protrude into the hollow space of the mold;

preheating the airfoil to a temperature that is between 50° and 300° C. below the solidus temperature of the lowest melting phase of the airfoil material;

filling the hollow space of the mold with the melt of a non-dispersion-hardened nickel-based superalloy intended for the shroud and the root at a casting temperature which is at the most 100° C. above the liquidus temperature of the highest melting phase of the non-dispersion-hardened nickel-based superalloy, in such a way that the tip end and the root end of the airfoil are completely cast around and cast in;

controlling the temperature of the melt, after the conclusion of the casting procedure and during solidification, and that of the airfoil so that any melting onto the airfoil and any metallurgical connection between the material of the airfoil and that of the shroud and the root is avoided; and cooling the whole workpiece to room temperature.

2. A method as claimed in claim 1, wherein the airfoil is machined out of semi-finished product which has previously been subjected to a heat treatment to increase the ductility at right angles to the longitudinal direction of the columnar crystals, or wherein the airfoil is subjected to a corresponding heat treatment after its manufacture, which consists of a heat treatment at or immediately above the lowest possible heat treatment temperature for solution of the $\gamma'$-phase in the $\gamma$-matrix of the airfoil material, followed by slow cooling at a maximum cooling rate of 5° C./ min.

3. A method as claimed in claim 1, wherein, before it is cast around and cast in, the airfoil is preheated to a temperature which at least reaches a value of 50° C.

below the lowest possible heat treatment temperature for solution of the $\gamma'$-phase in the $\gamma$-matrix of the airfoil material, and wherein the airfoil, after it is cast around and cast in, is cooled at a maximum cooling rate of 5° C./min. at least down to a temperature of 600° C., while the solidified melt forming the shroud and/or the root is cooled at an arbitrary cooling rate.

4. A method as claimed in claim 1, wherein the airfoil is provided with an intermediate layer of an oxide of at least one of the elements Cr, Al, Si, Ti and Zr of between 5 μm and 200 μm thickness at least at the tip end and at the root end before it is placed in the mold.

5. A method as claimed in claim 1, wherein the oxide-dispersion-hardened nickel-based superalloy of the airfoil has the following composition:

| | | |
|---|---|---|
| Cr = | 15.0 | % by weight |
| Al = | 4.5 | % by weight |
| Ti = | 2.5 | % by weight |
| Mo = | 2.0 | % by weight |
| W = | 4.0 | % by weight |
| Ta = | 2.0 | % by weight |
| Zr = | 0.15 | % by weight |
| B = | 0.01 | % by weight |
| C = | 0.05 | % by weight |
| $Y_2O_3$ = | 1.1 | % by weight |
| Ni = | rest | |

and wherein the airfoil is pre-heated to a temperature of between 1140° and 1180° C., wherein furthermore the nickel-based superalloy of the root and the shroud has the following composition:

| | | |
|---|---|---|
| Cr = | 16.0 | % by weight |
| Co = | 8.5 | % by weight |
| Mo = | 1.75 | % by weight |
| W = | 2.6 | % by weight |
| Ta = | 1.75 | % by weight |
| Nb = | 0.9 | % by weight |
| Al = | 3.4 | % by weight |
| Ti = | 3.4 | % by weight |
| Zr = | 0.1 | % by weight |
| B = | 0.01 | % by weight |
| C = | 0.11 | % by weight |
| Ni = | rest | |

and wherein the maximum casting temperature of the melt of the abovementioned composition is 1380° C.

6. A method as claimed in claim 1, wherein the oxide-dispersion-hardened nickel-based superalloy of the airfoil has the following composition:

| | | |
|---|---|---|
| Cr = | 15.0 | % by weight |
| Al = | 4.5 | % by weight |
| Ti = | 2.5 | % by weight |
| Mo = | 2.0 | % by weight |
| W = | 4.0 | % by weight |
| Ta = | 2.0 | % by weight |
| Zr = | 0.15 | % by weight |
| B = | 0.01 | % by weight |
| C = | 0.05 | % by weight |
| $Y_2O_3$ = | 1.1 | % by weight |
| Ni = | rest | |

and wherein the airfoil is preheated to a temperature of between 1160° and 1200° C., wherein furthermore the nickel-based superalloy of the root and the shroud has the following composition:

-continued

| | | |
|---|---|---|
| Cr = | 22.4 | % by weight |
| Co = | 19.0 | % by weight |
| Ta = | 1.4 | % by weight |
| Nb = | 1.0 | % by weight |
| Al = | 1.9 | % by weight |
| Ti = | 3.7 | % by weight |
| Zr = | 0.1 | % by weight |
| C = | 0.15 | % by weight |
| Ni = | rest | |

and wherein the maximum casting temperature of the melt of the abovementioned composition is 1400° C.

7. A method as claimed in claim 1, wherein the oxide-dispersion-hardened nickel-based superalloy of the airfoil has the following composition:

| | | |
|---|---|---|
| Cr = | 20.0 | % by weight |
| Al = | 6.0 | % by weight |
| Mo = | 2.0 | % by weight |
| W = | 3.5 | % by weight |
| Zr = | 0.19 | % by weight |
| B = | 0.01 | % by weight |
| C = | 0.05 | % by weight |
| $Y_2O_3$ = | 1.1 | % by weight |
| Ni = | rest | |

and wherein the airfoil is preheated to a temperature of between 1120° and 1160° C., wherein furthermore the nickel-based superalloy of the root and the shroud has the following composition:

| | | |
|---|---|---|
| Cr = | 16.0 | % by weight |
| Co = | 8.5 | % by weight |
| Mo = | 1.75 | % by weight |
| W = | 2.6 | % by weight |
| Ta = | 1.75 | % by weight |
| Nb = | 0.9 | % by weight |
| Al = | 3.4 | % by weight |
| Ti = | 3.4 | % by weight |
| Zr = | 0.1 | % by weight |
| B = | 0.01 | % by weight |
| C = | 0.11 | % by weight |
| Ni = | rest | |

and wherein the maximum casting temperature of the melt of the abovementioned composition is 1380° C.

8. A method as claimed in claim 1, wherein the oxide-dispersion-hardened nickel-based superalloy of the airfoil has the following composition:

| | | |
|---|---|---|
| Cr = | 20.0 | % by weight |
| Al = | 6.0 | % by weight |
| Mo = | 2.0 | % by weight |
| W = | 3.5 | % by weight |
| Zr = | 0.19 | % by weight |
| B = | 0.01 | % by weight |
| C = | 0.05 | % by weight |
| $Y_2O_3$ = | 1.1 | % by weight |
| Ni = | rest | |

and wherein the airfoil is preheated to a temperature of between 1120° and 1160° C., wherein furthermore the nickel-based superalloy of the root and the shroud has the following composition:

| | | |
|---|---|---|
| Cr = | 22.4 | % by weight |
| Co = | 19.0 | % by weight |
| W = | 2.0 | % by weight |
| Ta = | 1.4 | % by weight |
| Nb = | 1.0 | % by weight |
| Al = | 1.9 | % by weight |

-continued

| | |
|---|---|
| Ti = | 3.7 % by weight |
| Zr = | 0.1 % by weight |
| C = | 0.15 % by weight |
| Ni = | rest |

and wherein the maximum casting temperature of the melt of the abovementioned composition is 1400° C.

9. A method as claimed in claim 1, wherein the oxide-dispersion-hardened nickel-based superalloy of the airfoil has the following composition:

| | |
|---|---|
| Cr = | 17.0 % by weight |
| Al = | 6.0 % by weight |
| Mo = | 2.0 % by weight |
| W = | 3.5 % by weight |
| Ta = | 2.0 % by weight |
| Zr = | 0.15 % by weight |
| B = | 0.01 % by weight |
| C = | 0.05 % by weight |
| $Y_2O_3$ = | 1.1 % by weight |
| Ni = | rest |

and wherein the airfoil is preheated to a temperature of between 1130° and 1170° C., wherein furthermore the nickel-based superalloy of the root and the shroud has the following composition:

| | |
|---|---|
| Cr = | 16.0 % by weight |
| Co = | 8.5 % by weight |
| Mo = | 1.75 % by weight |
| W = | 2.6 % by weight |
| Ta = | 1.75 % by weight |
| Nb = | 0.9 % by weight |
| Al = | 3.4 % by weight |
| Ti = | 3.4 % by weight |
| Zr = | 0.1 % by weight |
| B = | 0.01 % by weight |
| C = | 0.11 % by weight |
| Ni = | rest |

and wherein the maximum casting temperature of the melt of the abovementioned composition is 1380° C.

10. A method as claimed in claim 1, wherein the oxide-dispersion-hardened nickel-based superalloy of the airfoil has the following composition:

| | |
|---|---|
| Cr = | 17.0 % by weight |
| Al = | 6.0 % by weight |
| Mo = | 2.0 % by weight |
| W = | 3.5 % by weight |
| Ta = | 2.0 % by weight |
| Zr = | 0.15 % by weight |
| B = | 0.01 % by weight |
| C = | 0.05 % by weight |
| $Y_2O_3$ = | 1.1 % by weight |
| Ni = | rest |

and wherein the airfoil is preheated to a temperature of between 1130° and 1170° C., wherein furthermore the nickel-based superalloy of the root and the shroud has the following composition:

| | |
|---|---|
| Cr = | 22.4 % by weight |
| Co = | 19.0 % by weight |
| W = | 2.0 % by weight |
| Ta = | 1.4 % by weight |
| Nb = | 1.0 % by weight |
| Al = | 1.9 % by weight |
| Ti = | 3.7 % by weight |
| Zr = | 0.1 % by weight |

-continued

| | |
|---|---|
| C = | 0.15 % by weight |
| Ni = | rest |

and wherein the maximum casting temperature of the melt of the abovementioned composition is 1400° C.

11. A method as claimed in claim 1, wherein the complete workpiece, after it has been cooled to room temperature, is again heated to a temperature of between 1050° and 1200° C. and at least the root and the shroud are subjected to postcompression by hot isostatic pressing, in such a way that the workpiece is first heated to a temperature which is at least 100° C. and a maximum of 150° C. lower than the recrystallization temperature of the material of both the airfoil and the shroud and the root and is, after this, placed under a pressure of between 1000 and 3000 bar at this temperature for between 2 and 24 hours and is then cooled at a maximum rate of 5° C./min at least down to a temperature of 600° C.

12. A composite gas turbine blade, comprising:

a root;

an airfoil having a root end adjacent the root and a tip end at the opposite end of the airfoil, said airfoil having depressions and/or protrusions on the root end and the tip end; and a shroud;

said airfoil comprising an oxide-dispersion-hardened nickel-based superalloy having longitudinally directed coarse columnar crystals;

the root and the shroud comprising a non-dispersion-hardened nickel-based cast superalloy;

the root and the shroud being connected purely mechanically to said airfoil by virtue of said root and said shroud including portions cast into the depressions and/or the protrusions on the root end and the tip end of the outside surface of the airfoil, while maintaining a metallic discontinuity between the airfoil and the shroud and root, and without any metallurgical connection therebetween.

13. A gas turbine blade as claimed in claim 12, wherein the metallic discontinuity between the airfoil and the shroud and/or between the airfoil and the root includes of a maximum width of 5 μm formed partially from a natural oxide layer and partially from hollow spaces.

14. A gas turbine blade as claimed in claim 12, wherein an intermediate layer of an oxide of at least one of the elements Cr, Al, Si, Ti and Zr of a thickness of between 5 μm and 200 μm is present on the surface of the airfoil in the metallic discontinuity between the airfoil and the root and/or between the airfoil and the shroud.

15. A gas turbine blade as claimed in claim 14, wherein the intermediate layer is designed as a firmly adhering layer of at least of 100 μm thickness on the surface of the airfoil, acting as thermal insulation in service, and consisting mainly of $Al_2O_3$ or of $ZrO_2$ stabilized with $Y_2O_3$.

16. A gas turbine blade as claimed in claim 12, wherein the airfoil is comprised of an oxide-dispersion-hardened, but not precipitation-hardened, nickel-based superalloy with increased ductility at right angles to the longitudinal direction of the columnar crystals.

17. A gas turbine blade or vane as claimed in claim 12, wherein the airfoil is comprised of an alloy with the following composition:

| | | |
|---|---|---|
| Cr = | 15.0 | % by weight |
| Al = | 4.5 | % by weight |
| Ti = | 2.5 | % by weight |
| Mo = | 2.0 | % by weight |
| W = | 4.0 | % by weight |
| Ta = | 2.0 | % by weight |
| Zr = | 0.15 | % by weight |
| B = | 0.01 | % by weight |
| C = | 0.05 | % by weight |
| $Y_2O_3$ = | 1.1 | % by weight |
| Ni = | rest. | |

18. A gas turbine blade as claimed in claim 12, wherein the airfoil is comprised of an alloy with the following composition:

| | | |
|---|---|---|
| Cr = | 20.0 | % by weight |
| Al = | 6.0 | % by weight |
| Mo = | 2.0 | % by weight |
| W = | 3.5 | % by weight |
| Zr = | 0.19 | % by weight |
| B = | 0.01 | % by weight |
| C = | 0.05 | % by weight |
| $Y_2O_3$ = | 1.1 | % by weight |
| Ni = | rest. | |

19. A gas turbine blade as claimed in claim 12, wherein the airfoil is comprised of an alloy with the following composition:

| | | |
|---|---|---|
| Cr = | 17.0 | % by weight |
| Al = | 6.0 | % by weight |
| Mo = | 2.0 | % by weight |
| W = | 3.5 | % by weight |
| Ta = | 2.0 | % by weight |
| Zr = | 0.15 | % by weight |

-continued

| | | |
|---|---|---|
| B = | 0.01 | % by weight |
| C = | 0.05 | % by weight |
| $Y_2O_3$ = | 1.1 | % by weight |
| Ni = | rest. | |

20. A gas turbine blade as claimed in claim 12, wherein the root (7) and the shroud are comprised of an alloy with the following composition:

| | | |
|---|---|---|
| Cr = | 16.0 | % by weight |
| Co = | 8.5 | % by weight |
| Mo = | 1.75 | % by weight |
| W = | 2.6 | % by weight |
| Ta = | 1.75 | % by weight |
| Nb = | 0.9 | % by weight |
| Al = | 3.4 | % by weight |
| Ti = | 3.4 | % by weight |
| Zr = | 0.1 | % by weight |
| B = | 0.01 | % by weight |
| C = | 0.11 | % by weight |
| Ni = | rest. | |

21. A gas turbine blade as claimed in claim 12 wherein the root and the shroud are comprised of an alloy with the following composition:

| | | |
|---|---|---|
| Cr = | 22.4 | % by weight |
| Co = | 19.0 | % by weight |
| W = | 2.0 | % by weight |
| Ta = | 1.4 | % by weight |
| Nb = | 1.0 | % by weight |
| Al = | 1.9 | % by weight |
| Ti = | 3.7 | % by weight |
| Zr = | 0.1 | % by weight |
| C = | 0.15 | % by weight |
| Ni = | rest. | |

* * * * *